United States Patent [19]

Fitzsimons

[11] 4,010,743

[45] Mar. 8, 1977

[54] FOOT MASSAGER

[76] Inventor: Ron Fitzsimons, 5557 Fleming St., Vancouver, British Columbia, Canada

[22] Filed: Mar. 30, 1976

[21] Appl. No.: 672,043

[52] U.S. Cl. ..... 128/57; 128/25 B

[51] Int. Cl.² ..... A61H 15/00

[58] Field of Search ..... 128/57, 25 B, 67, 65

[56] References Cited

UNITED STATES PATENTS

| | | | |
|---|---|---|---|
| 2,072,959 | 3/1937 | Mulvaney et al. | 128/57 |
| 2,438,249 | 3/1948 | Mattison | 128/57 |
| 2,638,089 | 5/1953 | Murphy | 128/25 B |
| 3,292,614 | 12/1966 | Fleming | 128/57 |

FOREIGN PATENTS OR APPLICATIONS

| | | | |
|---|---|---|---|
| 197,715 | 8/1938 | Switzerland | 128/57 |

*Primary Examiner*—Lawrence W. Trapp
*Attorney, Agent, or Firm*—Robert D. Farkas

[57] ABSTRACT

A foot massager which has a frame which supports a number of rods removably secured thereto. The rods are parallel to each other and lie in the same plane. The plane is tilted slightly so that it is sloped and not parallel with the floor below. Each rod has a plurality of uniformly sized beads thereupon whose diameters are slightly larger than the diameter of any rod, enabling them to spin or rotate around the rods. The user places his feet on the beads and moves them up and down along the slanted plane causing the beads to rotate as they contact the user's feet, thus massaging and stimulating the nerve endings, muscles, and blood vessels located in the sole of each foot.

6 Claims, 4 Drawing Figures

FOOT MASSAGER

BACKGROUND OF THE INVENTION

1. The Field of the Invention

This invention relates to massaging and rolling devices for feet, which when utilized, relieve and sooth the tired feet of the user, creating thereby beneficial phisiological effects throughout the body.

2. Description of the Prior Art

The prior art abounds with rollers having contoured constructions to fit the shape of the human foot. Other devices employ rollers which are staggered in diameter while still other devices mount rollers eccentrically to achieve an effective massaging pattern.

SUMMARY OF THE INVENTION

This invention relates to a foot massaging apparatus adapted to massage the soles of both feet that are alternately moved along the surface of beads mounted on beadbearing rods. A platform is fabricated with a lateral base element adapted to rest upon the ground or other substantially horizontal surface. Two opposed longitudinal edges of the platform are adapted with a plurality of uniformly spaced notches located along the length in the uppermost edges thereof. A number of rods are provided that are adapted with rectangularly shaped elements located at each free end thereof. These rectangularly shaped elements may be fitted into the opposing notches aforementioned such that the uppermost surfaces of the beads project upwardly from the plane defined by the uppermost edges of the aforementioned opposing sides of the supporting structure. A number of rods may be inserted into adjacent notches, or if desired, rods may be ommitted from selected notches, permitting thereby, a variety of frictional forces to be induced into various portions of the soles of the feet. Since all the beads are of uniform diameter and are in touching engagement along the length of each rod, the entire width of the soles of the feet may be effectively messaged when agitating the foot on the surface of the beads along the direction of a line defined running longitudinally between the heels and toes of the user.

Additional support is provided to the rods along a line intermediate and parallel to the rectangular blocks secured to the free ends of each rod by an additional supporting vertical surface whose uppermost edge lies in the same plane as the uppermost edges of the two opposed parallel sides of the supporting structure. A rectangular block replaces the centermost bead and is adapted to be inserted into similarly spaced knotches in the center vertical partition as the spacing of the knotches in the uppermost edges of the opposed sides of the supporting structure.

Rods may be deleted at will, by virtue of this unique contruction, from selected locations in every adjacent knotch, permitting the user thereby to select those areas of the feet which may require more intensive massaging.

A primary object of the instant invention is to provide a foot massager which massages and stimulates tired, weary feet.

Another object is to provide a foot massager which may be employed with the user in the sitting position.

Still another object is to provide a foot massager with uniformly sized rotatable beads which knead and massage feet, penetrating to the reflex nerves which effectively sooth and relax the user.

Yet another object is to provide a foot massager in which rows of beads may be located in various positions in the plane of use at the will of the user.

A further object is to provide a foot massager whose bead supporting rods may be removed or installed simply and effectively in the plane of use.

Another object is to provide a foot massager wherein the beads are substantially located in a plane forming an angle to the horizontal plane formed by the ground.

Still another object is to provide a foot massager wherein every bead employed has uppermost tangential lines lying in a common plane.

These objects, as well as other objects of this invention, will become readily apparent after reading the following description of the accompanying drawings.

DESCRIPTION OF THE PREFERRED EMBODIMENT

The structure and method of fabrication of the present invention is applicable to a foot massager having a box-like hollow supporting structure whose uppermost edges form a plane lying at an anglewith the lowermost edges adapted to lie in a horizontal plane. The uppermost edges on two opposed sides and an intermediate edge, parallel thereto, are adapted with a plurality of uniformly spaced notches along the lengths thereof. The intermediate edge is centered between the opposed edges providing thereby a line deliniating the placement of the soles of each foot of the user. Three notches, each of which is located in each of the uppermost supporting edges of the supporting structure, fall on a common line and are adapted to engage a rectangular cube fixedly secured along the length of a rod. Intermediate the notch engaging rectangular cube elements are a number of touching spheres adapted to rotate about the rod. A number of sphere equipped rods as described heretofore are mechanically positioned in parallel fashion within the rod-like notches such that adjacent notches are occupied with the rectangular cube notch engaging elements. The apparatus may be utilized with a total number of rods, having spheres thereupon, equal in number to one third the total number of notches. When this number of rods are employed, a complete pattern of spheres are utilized such that the spheres are deployed along lines parallel to each other and parallel to the uppermost edges of the supporting structure in which the notches are located. Since the spheres are in touching engagement along the rod, the user effectively massages the soles of the feet along lines parallel with the length thereof, in uniform intensity. When one or more rods are deleted from the aforementioned notches, the massaging lines are shortened to a maximum length determined by the degree of pedal manipulation achieved by the user over the discontinuous length of beads lined up along the line aforementioned. This promotes selective massaging in accordance with the effects the user wishes to achieve.

Figure 1:
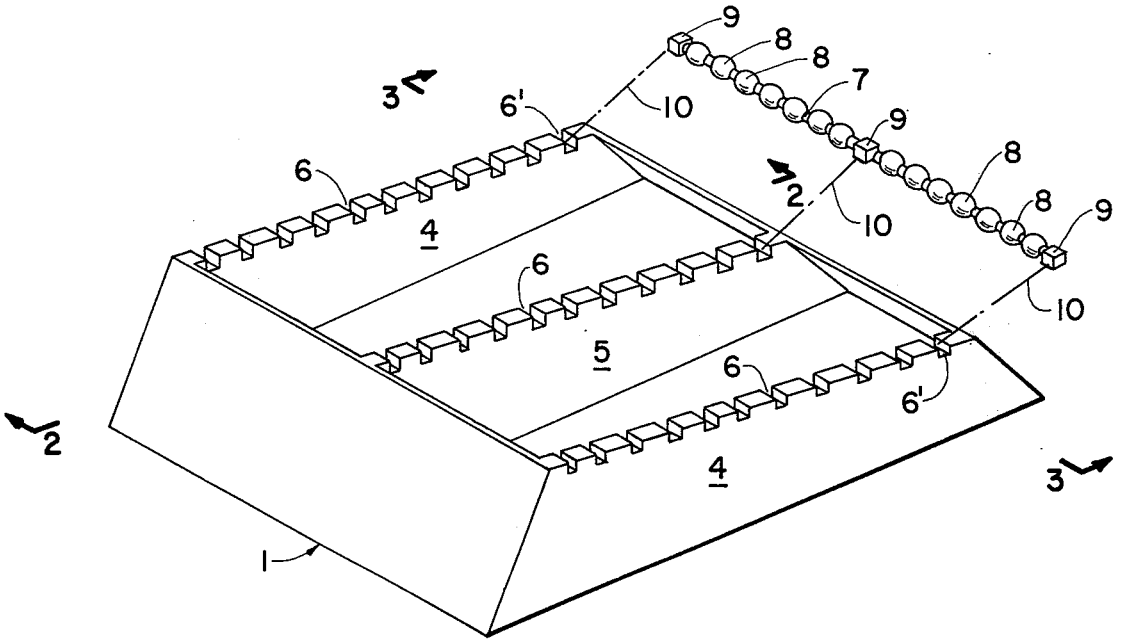
FIG. 1 is a perspective exploded view of the supporting structure and one bead rod with beads thereupon.

Now referring to the Figures, and more particularly to the embodiment illustrated in FIG. 1 showing the supporting structure 1 having opposed parallel sides 4 and an intermediate internal parallel partition 5. Notches 6 are located in the uppermost edges of side walls 4 and partition 5. Rod 7 is provided with a plurality of beads 8 rotatably secured along the longitudinal axis thereof. Rectangular blocks 9 are adapted to engage notches 6' when rod 7 is moved along dotted lines 10.

Figure 2:
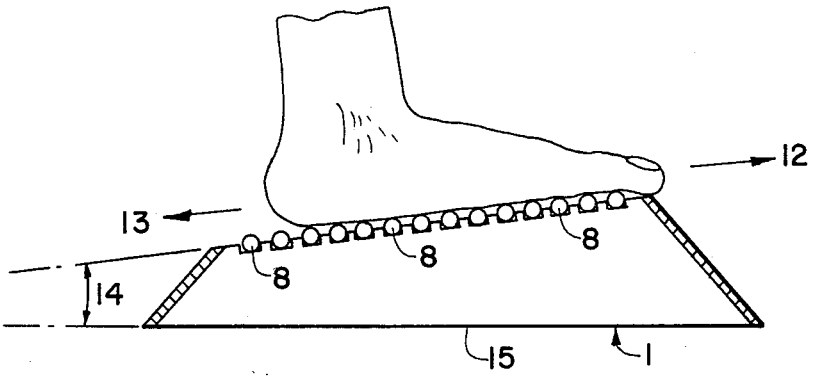
FIG. 2 is a cross-sectional view taken along line 2—2 viewed in the direction of arrows 2—2 as shown in FIG. 1 illustrating the supporting structure and a full complement of beads thereupon being utilized massaging the foot of a user.

FIG. 2 illustrates the foot 11 of the user adapted to be manipulated in the directions of arrows 12 and 13 alternately. Beads 8 lie in a plane forming an angle 14 with the base 15 of the supporting structure 1.

Figure 3:
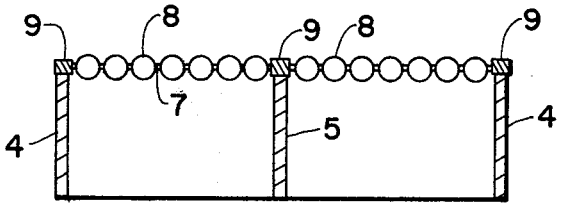
FIG. 3 is a cross-sectional view taken along line 3—3 viewed in the direction of arrows 3—3 as shown in FIG. 1 showing one row of beads supported atop three longitudinal edges of the supporting structure.

FIG. 3 is a cross-sectional view taken along line 3—3 viewed in the direction of arrows 3—3 as shown in FIG. 1 illustrating side walls 4 and partition 5 supporting the rod 7 and the beads 8 thereupon.

Figure 4:
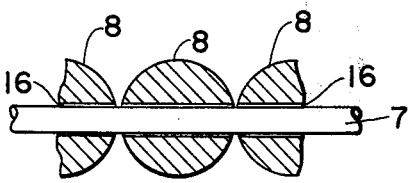
FIG. 4 is a cross-sectional view of a portion of the length of one rod illustrating the beads mounted thereupon in touching engagement.

FIG. 4 shows beads 8 in touching engagement along rod 7 and having holes 16 therethrough permitting the rotation of the beads about the rod 7.

One of the advantages is a foot massager which massages and stimulates tired, weary feet.

Another advantage is a foot massager which may be employed with the user in the sitting position.

Still another advantage is a foot massager with uniformly sized rotatable beads which knead and massage feet, penetrating to the reflex nerves which effectively sooth and relax the user.

Yet another advantage is a foot massager in which rows of beads may be located in various positions in the plane of use at the will of the user.

A further advantage is a foot massager whose bead supporting rods may be removed or installed simply and effectively in the plane of use.

Another advantage is a foot massager wherein the beads are substantially located in a plane forming an angle to the horizontal plane formed by the ground.

Still another advantage is a foot massager wherein every bead employed has uppermost tangential lines lying in a common plane.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited not by the specific disclosure herein, but only by the appending claims.

The embodiment of the invention in which an exclusive privilege or property is claimed are defined as follows:

I claim:

1. A foot massager comprising a supporting frame adapted to be located upon a floor or other horizontal supporting surface, spacing means adapted to provide a first and second row of uniformly spaced rod locating points located on two opposed uppermost marginal edges of said supporting frame, rods locating means adapted at the free ends of each of said rods providing removable engagement with said two opposed uppermost marginal edges and said locating points, a plurality of uniform diameter spherical balls each in touching engagement along each of said rods intermediate said rods locating means adapted to rotate about cylindrical holes whose longitudinal axes pass through the origins of said balls, said rods passing through said cylindrical holes, a plurality of individual rods fitted with said balls thereupon having parallel longitudinal axes the free ends thereof aligned along said two marginal edges, one of said rods fitted with said balls selectively adapted to be located parallel to another of said rods having a distance between disimilar to the distance between another pair of adjacent parallel rods.

2. The foot massager as claimed in claim 1 further comprising a third row of uniformly spaced rod locating points located intermediate said two marginal edges and parallel thereto, the spacing separating said rod locating points of said third row equal to the spacing separating said rod locating points of said first and said second rows, second rods locating means along said rods substantially centrally located between the free ends of said rods adapted to selectively support said rods along said third row.

3. The foot massager as claimed in claim 2 wherein said third row lies in the plane formed by said two marginal edges.

4. The foot massager as claimed in claim 1 wherein said marginal edges lie in a plane forming an acute angle with said horizontal surface.

5. The foot massager as claimed in claim 1 wherein said rods locating means comprises supporting cubes fastened to said rods adjacent the free ends thereof adapted to fit within a first and second row of square notches located at each of said uniformly spaced rod locating points.

6. The foot massager as claimed in claim 2 wherein said second rods locating means comprises supporting cubes fastened to said rods intermediate the free ends thereof adapted to fit within a third row of square notches located along a portion of said supporting frame lying in the same plane equidistant said marginal edges thereof.

* * * * *